United States Patent [19]

Gilligan, III et al.

[11] 4,337,126

[45] Jun. 29, 1982

[54] ELECTROLYSIS OF CARBONATES TO PRODUCE HYDROXIDES

[75] Inventors: Thomas J. Gilligan, III, Painesville; Thomas G. Strempel, Euclid; Martin M. Dorio, Mentor; Andrew D. Babinsky, Chagrin Falls, all of Ohio

[73] Assignee: Diamond Shamrock Corporation, Dallas, Tex.

[21] Appl. No.: 201,209

[22] Filed: Oct. 27, 1980

[51] Int. Cl.[3] ..... C25B 1/16; C25B 1/02; C25B 1/00

[52] U.S. Cl. ..... 204/98; 204/101; 204/129

[58] Field of Search ..... 204/101, 98, 129

[56] References Cited

U.S. PATENT DOCUMENTS

| | | | |
|---|---|---|---|
| 2,317,600 | 4/1943 | Benedict | 204/98 |
| 3,344,050 | 9/1967 | Mayland et al. | 204/98 |
| 3,692,649 | 9/1972 | Prigent et al. | 204/101 |
| 4,025,405 | 5/1977 | Dotson et al. | 204/98 |
| 4,246,079 | 1/1981 | Goodrich et al. | 204/98 |

*Primary Examiner*—R. L. Andrews
*Attorney, Agent, or Firm*—John P. Hazzard

[57] ABSTRACT

The invention is directed to an electrolytic process for converting alkali metal carbonates to alkali metal hydroxides at high current efficiencies.

9 Claims, 1 Drawing Figure

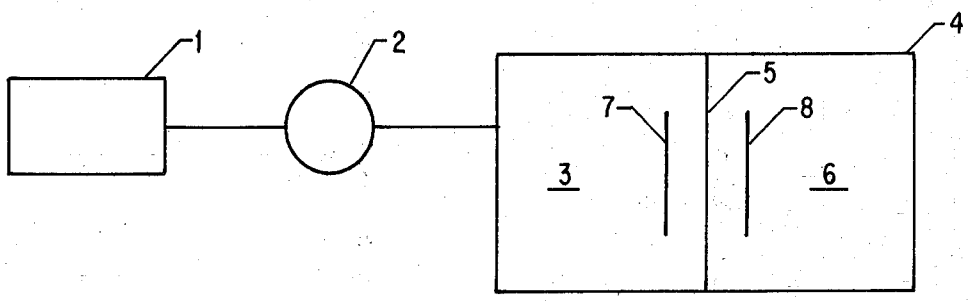
1
2
4
5
7
8
3
6

ELECTROLYSIS OF CARBONATES TO PRODUCE HYDROXIDES

BACKGROUND OF THE INVENTION

The process is directed to electrolytic production of hydroxides of alkali metal from alkali metal carbonate containing waste streams and naturally occurring carbonate and/or bicarbonate deposits or ores.

Alkali metal carbonates are produced as by-products in a variety of processes which rely on other alkali metal salts or alkali metal hydroxides as reactants or as treating agents. Conversion of the alkali metal carbonates to alkali metal hydroxides for reuse is thus desirable and is an object of the invention.

The invention advantageously substantially obviates the use of chemicals other than water to convert the alkali carbonate to the hydroxides. The process of the invention advantageously produces carbon dioxide, which is a valuable by-product. As an electrolytic process, the process of the invention advantageously operates at high efficiencies.

SUMMARY OF THE INVENTION

The invention comprises a process for recovering alkali metal hydroxide in aqueous solution from solutions of alkali metal carbonates by (1) feeding the alkali metal carbonate solution to the anodic compartment of an electrolytic cell, and maintaining the contents of the anodic compartment at a temperature above ambient temperature; and (2) passing an electric current through the electrolytic cell which is divided into anodic and cathodic compartments by a cation permselective membrane, whereby carbonate ion is removed as $CO_2$ gas from the solution in the anodic compartment and alkali metal hydroxide is produced in the cathodic compartment.

BRIEF DESCRIPTION OF THE FIGURE

The FIGURE represents in a schematic manner the apparatus used in the process of the invention. Pump 2 supplies alkali metal carbonates from the storage tank 1 to an anodic compartment 3 which contains an anode 7, attached to leads not specifically exemplified. During operation of the electrolytic cell 4, alkali metal ions pass through the cation permselective membrane 5 into a cathodic chamber 6 which is provided with a cathode 8 (attached to leads not specifically depicted) and are reacted with hydroxyl ions produced at the cathode, thereby producing alkali metal hydroxide.

The invention will be discussed below in the "Detailed Description of the Invention", with reference to the FIGURE.

DETAILED DESCRIPTION OF THE INVENTION

The carbonate solution feeds which are subjected to electrolysis in accordance with the invention may contain alkali metal carbonate alone and may also contain alkali metal bicarbonates, impurities or mixtures of alkali metal bicarbonates and impurities. The alkali metal carbonate concentrations of the potassium carbonate solution feeds can range from about 85 to about 600 grams per liter. For sodium bicarbonate the solubility is less, so that the range of concentration can be about 50 grams per liter to about 450 grams per liter. The pH of the feed solution can range from about 9 to about 12.

The feed is introduced into the anodic compartment 3 of the electrolytic cell 4. The feed can be introduced by a pump 2, which can be a metering pump, so that the feed is introduced to the anolyte at a rate which is nonlinear. Alternatively, the rate of introduction of carbonate feed can be linear. For instance, in runs described in Table I below, the rate of feed introduction was approximately one cc/amp. min., although lower or higher feed rates can also be used.

The electrolytic cell contains a cation permselective membrane 5. Cation permselective membranes contain exchange groups on homogeneous or hetergeneous sheets. These exchange groups may be acidic groups, such as sulphonic, carboxylic phosphonic, or other groups which exhibit cation exchange properties. For instance, it is preferred to use certain "Nafion" membranes made by E. I. duPont deNemours and Co., Wilmington, Del.; "Nafion" is a membrane which contains perfluorosulfonic acid groups as the cation exchange groups. The cation permselective membranes are generally inert to the electrolytic process conditions. Other membranes can also be used. For example, membranes containing carbon-hydrogen bonds instead of carbon-fluorine bonds can be used in the practice of the invention. Any electrolysis membrane can be used. See, e.g., U.S. Pat. No. 2,681,320 to Bodamer; U.S. Pat. No. 3,887,499 to Hodgson; U.S. Pat. No. 3,902,947 to Grot; U.S. Pat. No. 4,154,909 to Seita; U.S. Pat. No. 4,178,218 to Seko; and British Patent Specification No. 851,785.

The anodic compartment of the electrolytic cell is provided with an anode 7. Preferably the anode 7 is a dimensionally stable anode such as a "DSA"-brand anode sold by Diamond Shamrock Corporation. A platinum-iridium anode, as described in U.S. Pat. No. 3,878,083 at column 4, Table 1, has been found to be quite suitable. Other oxygen evolving electrodes may be used as the anode, including for example the electrodes described in U.S. Pat. No. 3,776,834 to O'Leary and U.S. Pat. No. 3,875,043 to Franks, Schenker, O'Leary and Kolb. The cathode 8 can be, for example, a nickel or steel cathode. The electrolytic cell normally is equipped with a platinum-iridium anode or other $O_2$ evolving anode and a parallel plate nickel cathode. In experiments described herein, the cathode membrane gap is 0" and the anode-membrane gap is about 1/16". Alternatively, the anode may be a hydrogen depolarized anode which may utilize the hydrogen gas generated in the cathode compartment to thereby reduce the cell voltage and simultaneously remove oxygen from the $CO_2$ produced in the anode compartment.

The anolyte temperature is maintained at temperatures greater than ambient temperatures throughout the process of the invention. Generally, the temperature of the anolyte is maintained at about 90° C. The elevated temperature of the anolyte may depend on the concentration of alkali metal bicarbonate in the feed, and the boiling point of the feed solution. Preferably the temperature of the anolyte is at or near the boiling point of the feed solution. The contents of anodic compartment can be maintained at elevated temperatures, by conventional means, e.g., a heater, not shown in the FIGURE.

In the practice of the present invention, when a standard electrolytic cell is utilized, a current is passed between the anode and cathode which are separated by the permselective membrane. In the anode compartment is an aqueous solution of sodium carbonate and/or bicarbonate. Water is electrolyzed at the anode surface to yield oxygen gas and hydrogen ion which then reacts with the carbonate ion present in the anolyte to yield bicarbonate ion, which in turn reacts with more hydrogen ion to yield carbonic acid, which breaks down into water and $CO_2$ in accordance with the following equations:

$$H_2O \rightarrow \tfrac{1}{2}O_2 \uparrow + 2H^+$$

$$CO_3^= + H^+ > HCO_3^-$$

$$HCO_3^- + H^+ > H_2CO_3 > H_2O + CO_2$$

Thus, in the anolyte compartment, oxygen gas and carbon dioxide gas are given off and the anolyte is constantly renewed with a new supply of sodium carbonate and/or sodium bicarbonate solution.

At the cathode, water is likewise electrolyzed yielding hydrogen gas and hydroxyl ions. The sodium ions from the anolyte compartment are attracted by the cathode and passed through the permselective membrane and react in the catholyte compartment with the generated hydroxyl ions to yield a caustic solution which is continuously or intermittently withdrawn. Makeup water is required in the catholyte chamber and is supplied as required.

If, on the other hand, the hydrogen depolarized anode is utilized in the practice of the present invention, the hydrogen gas formed at the cathode is recycled to the anode and rather than form oxygen gas the oxygen ions as they are formed react with the hydrogen to form water. In this case the $CO_2$ being produced from the anode compartment would be of much higher purity as the oxygen content thereof would either be non-existent or much lower concentration.

Both the anode and cathode compartments operate with an alkaline pH, usually about 8–12. Thus cheaply constructed cells can be utilized as they do not have to withstand acid conditions. In addition, as long as there is sodium carbonate in the anolyte, the anolyte compartment is self-buffered which prevents the anolyte from becoming acid.

The current densities employed are not particularly critical. During operations of electrolytic cells, to effect the process of the invention, illustrated herein, current densities were usually about 2 amperes/square inch. The current efficiencies of this electrolytic process are high, as can be seen from the results set forth in the following tables.

The results of examples demonstrating the process of the invention are set forth in Tables I-V.

Table I demonstrates the high cell current efficiency in the production of the alkali metal hydroxide, potassium hydroxide, from feed streams with concentration of $K_2CO_3$ ranging from 85 to 550 grams per liter. The current efficiencies at high carbonate concentrations are excellent and comparable to those being obtained in KCl electrolysis. All runs were made over from three to five days.

TABLE I

| Potassium Carbonate Feed Cell | | | | |
|---|---|---|---|---|
| Feed | | Product | | |
| $K_2CO_3$ | KOH | KOH | C.E. % | Voltage |
| 530 | 16 | 357 ± 4 | 97.8 ± 1.1 | 4.86 + .04 |
| 437 | 11 | 346 ± 1 | 97.6 ± 0.4 | 4.39 ± .03 |
| 357 | 6 | 330 ± 2 | 98.4 ± 1.1 | 4.21 ± .05 |
| 259 | 3 | 321 ± 5 | 98.5 ± 1.1 | 4.05 ± .02 |
| 168 | 2 | 330 ± 3 | 98.5 ± 0.5 | 4.07 ± .02 |
| 167 | 2 | 450 ± 4 | 90.5 ± 1.0 | 4.15 ± .01 |
| 164 | 1 | 304 ± 10 | 98.5 ± 0.5 | 4.06 ± .01 |

TABLE I-continued

| Potassium Carbonate Feed Cell | | | | |
|---|---|---|---|---|
| Feed | | Product | | |
| $K_2CO_3$ | KOH | KOH | C.E. % | Voltage |
| 84 | 0 | 300 ± 9 | 94.5 ± 0.4 | 4.67 ± .06 |
| 213 | 4 | 309 ± 3 | 95.2 ± 0.4 | 3.59 ± .04 |

+The membrane used in this cell was 1100/5/T-24 standard Nafion.
++Concentrations are in grams/liter.

Table II demonstrates the recovery of the $CO_2$ value from a feed containing $K_2CO_3$ and $KHCO_3$. The electrolytic cell was placed in a closed loop for this test. The data in Table II record the results of the end of the run when the initial $K_2CO_3$ charge was essentially depleted. The reactions in the anolyte here converts bicarbonate to carbonic acid, which, in turn disassociates into $CO_2$ (gas) and water.

TABLE II

| $CO_2$ Recovery from $K_2CO_3/KHCO_3$ Feed | | | | | | | |
|---|---|---|---|---|---|---|---|
| Feed | | Effluent | | Gas Sample, % | | | |
| $K_2CO_3$ | $KHCO_3$ | $K_2CO_3$ | $KHCO_3$ | $CO_2$ | $O_2$ | $N_2$ | DOL |
| 55 | 108 | 26 | 115 | 66 | 30 | Trace | 60 |
| 36 | 90 | 18 | 74 | 70 | 24 | 4 | 63 |

Inlet pH: 9.5
Exit pH: 9.2

The data in Table III record results of a closed loop set-up for electrolysis of a feed containing $K_2CO_3$ and $KHCO_3$. In Table III decrease in bicarbonate concentration reflects $CO_2$ evolution after DOL 59 (days on line). The feed tends to buffer itself to basic pH by expelling $CO_2$. The current efficiency on recycle remained high; and the voltage was even lower until the feed was substantially depleted, when current efficiency dropped and voltage increased as can be seen in Table III.

TABLE III

| Feed | | Product | | | |
|---|---|---|---|---|---|
| $K_2CO_3$ | $KHCO_3$ | KOH | V | C.E. % | DOL |
| 210 | 4* | 305 | 3.57 | 95.5 | 49* |
| 193 | 20 | 308 | 3.58 | 95.1 | 51 |
| 160 | 47 | 311 | 3.60 | 95.6 | 53 |
| 124 | 52 | 306 | 3.64 | 95.6 | 55 |
| 87 | 94 | 299 | 3.64 | 94.7 | 57 |
| 64 | 110 | 299 | 3.84 | 94.4 | 59 |
| 48 | 103 | 283 | 3.77 | 93.0 | 61 |
| 36 | 90 | 287 | 3.89 | 90.8 | 63 |
| 26 | 70 | 295 | 4.41 | 89.7 | 65 |
| 17 | 47 | 290 | 6.45 | 87.4 | 67 |

*first day on closed loop
*KOH in gpl
All concentration in gpl.

The results of an open loop electrolysis of a $Na_2CO_3$ feed are set forth in Table IV. In a cell employing the same membrane as was used in electrolysis of $K_2CO_3$ feeds, the current efficiency was lower and comparable to that expected for electrolysis of a NaCl feed. However, use of amine modified, or carboxylic, or carboxylic modified, permselective cation membrane improves the current efficiency of electrolysis of $Na_2CO_3$ feeds as does use of these membranes in chlor-alkali cells. It is expected that electrolysis of $Na_2CO_3$ can be optimized by control of caustic concentration in conjunction with appropriate cation permselective membranes.

TABLE IV

| Nafion Membrane | Sodium Carbonate Feed Cell Voltage | Product NaOH | C.E. % | DOL |
|---|---|---|---|---|
| 1100/5/T-24 | 3.71 ± .08 | 425 ± 5 | 72.5 ± 1.7 | 8–14 |
| 1150/7/.5E/ | 3.81 ± .05 | 392 ± 16 | 84.5 ± 3.1 | 1–7 |
| T-24 | 3.88 + .06 | 333 ± 12 | 82.1 ± 1.8 | 10–14 |
| Feed Concentration | 190 gpl $Na_2CO_3$ 6 gpl NaOH | | | |
| Effluent | 180 gpl $Na_2CO_3$ 10 gpl $NaHCO_3$ | | | |

In Table V, the result of electrolysis of some carbonate-spiked feeds are recorded. Current efficiencies typical of previous runs on carbonate alone are demonstrated in these experiments in which standard Nafion membranes were employed in the cell. Analysis of effluent brines indicated that carbonate was converted to bicarbonate, or at lower flow rates to $CO_2$. The chloride salts in these feeds were not electrolyzed to any great extent until $CO_2$ was expelled at which time the pH of the anolyte dropped and large amounts of hypochlorite and chlorate are produced. The results of the third example in Table V indicate that optimal current efficiencies are realized at NaOH product concentrations at around 500 gpl. In these examples, oxygen evolution occurred at the anode, and chlorine evolution at the anode partially or totally ceased. In the last two examples of Table V, carbonate removal and KOH or NaOH production at high current efficiencies and low voltages is demonstrated. Accordingly, electrolysis of carbonate containing feed streams in accordance with the invention is demonstrated to be applicable to carbonate removal from feed streams containing large concentrations of other salts, which in terms of carbonates referred to herein, are impurities.

TABLE V

| Feed NaCl | Feed NaOH | Basic Brine Feed Product NaOH | V | C.E. % | DOL |
|---|---|---|---|---|---|
| 275 | 3 | 442 ± 1 | 4.02 ± .09 | 62.2 ± .2 | 2–3 |
| | | 508 ± 10 | 4.32 ± .10 | 71.4 ± .6 | 4–6 |
| | | 512 ± 8 | 4.19 ± .05 | 66.4 ± 3.1 | 10–16 |
| | | 503 ± 8 | 4.06 ± .09 | 59.9 ± 3.1 | 18–30 |
| KCl | $K_2CO_3$ | KOH | | | |
| 225 | 50* | 515 ± 17 | 5.36 ± .21 | 72.7 ± 2.3 | 2–7 |
| 265 | 55** | 394 ± 16 | 4.41 ± .15 | 87.9 ± 3.1 | 9–19 |
| NaCl | $Na_2CO_3$ | | | | |
| 250 | 40 | 590 ± 17 | 4.63 ± .16 | 71.6 ± 2.1 | 5–8 |
| | | 492 ± 8 | 4.34 ± .09 | 75.0 ± 1.8 | 9–12 |
| | | 445 ± 8 | 4.01 ± .16 | 73.7 ± 3.6 | 13–16 |
| | | 392 ± 10 | 3.96 ± .27 | 60.3 ± 3.6 | 17–26 |
| Membranes: | 1100/5/T-24 Nafion | | | | |
| Anodes: | NaCl are described in U.S. Pat. No. 3,776.834 KCL is platinum-iridium electrodes as described above | | | | |
| Effluent | *269 KCL | | **260 KCl | | |
| | 13 $K_2CO_3$ | | 0 $K_2CO_3$ | | |
| | 27 $KHCO_3$ | | 0 $KHCO_3$ | | |
| | 1 KC10 | | 3 KC10 | | |
| | 2 $KC10_3$ | | 13 $KC10_3$ | | |

It is understood that various other modifications will be apparent to and can readily be made by those skilled in the art without departing from the spirit and scope of this invention. Accordingly, it is not intended that the scope of the claims appended hereto be limited to the description set forth herein but rather that the claims be construed as encompassing all the features of patentable novelty which reside in the present invention including all features which would be treated as equivalents thereof by those skilled in the art to which the invention pertains.

What is claimed is:

1. An electrolytic process for recovering alkali metal hydroxide from a solution consisting essentially of the carbonate of said alkali metal, comprising:

(1) an electrolytic cell having a cation permselective membrane which separates the cell into two compartments, namely a cathodic compartment and an anodic compartment;

(2) feeding said solution of carbonates into the anodic compartment, and maintaining an alkali metal hydroxide solution, in the cathodic compartment which is electrolytically conductive under the conditions of the process;

(3) heating the contents of the anodic compartment to a temperature above ambient temperature and maintaining the contents of said anodic compartment at said above ambient temperature throughout the process;

(4) passing an electrical current through the electrolytic cell, whereby alkali metal ion passes through said membrane into the cathodic compartment in which essentially pure hydroxide of said alkali metal is produced while $CO_2$ is generated from the anolyte.

2. The process of claim 1, wherein the said temperature of the anodic compartment contents may range up to a temperature of about the boiling point of the feed solution.

3. The process of claim 1 or 2, wherein said anodic compartment is provided with an oxygen evolving electrode.

4. The process of claim 1, wherein said solution is fed into the anodic compartment at a rate which is linear.

5. The process of claim 1, wherein the alkali metal carbonate is potassium carbonate, or a mixture of potassium bicarbonate and carbonate.

6. The process of claim 5, wherein the cation permselective membrane contains exchange groups which are potassium sulfonate groups.

7. The process of claim 1, wherein the alkali metal carbonate is sodium carbonate, or a mixture of sodium bicarbonate and carbonate.

8. The process of claim 7, wherein the cation permselective membrane sulfonic exchange groups which are amine modified sulfonate groups, or carboxylic groups.

9. The process of claim 1, 2, 4, 5, 6, 7 or 8, wherein said anodic compartment is provided with a hydrogen depolarized anode and hydrogen is generated in the cathodic compartment and said hydrogen is recycled to said anode compartment for depolarizing the anode.

* * * * *